United States Patent [19]

Benning et al.

[11] Patent Number: 4,805,264

[45] Date of Patent: Feb. 21, 1989

[54] SUSPENSION MECHANISM FOR A HINGED PART

[75] Inventors: Friedrich Benning, Schwetzingen; Berthold Grosse-Kohorst, Lohne/Maerschendorf, both of Fed. Rep. of Germany

[73] Assignee: Deere & Company, Moline, Ill.

[21] Appl. No.: 67,831

[22] Filed: Jun. 26, 1987

[30] Foreign Application Priority Data

Jun. 30, 1986 [DE] Fed. Rep. of Germany ..... 3621915

[51] Int. Cl.[4] ..... E05D 7/10; E05F 3/02

[52] U.S. Cl. ..... 16/267; 16/291; 16/358; 16/360; 180/69.21

[58] Field of Search ..... 16/291, 293, 358, 359, 16/360, 254, 255, 267; 180/69.2, 69.21; 220/337

[56] References Cited

U.S. PATENT DOCUMENTS 4,359,119 11/1982 Kammerman ..... 180/69.21
4,584,589 4/1986 Bivins et al. ..... 16/358

FOREIGN PATENT DOCUMENTS 452098 10/1949 Italy ..... 220/337
452068 10/1949 Italy ..... 16/358
1050652 12/1966 United Kingdom ..... 16/255

*Primary Examiner*—Nicholas P. Godici
*Assistant Examiner*—Edward A. Brown

[57] ABSTRACT

A suspension mechanism is provided for a hinged part, such as the engine hood of an agricultural tractor. The top of the engine hood is pivoted on an axle via a forked bearing. A follower on the bottom of the engine hood is guided in a track on the vehicle tractor frame. A support strut is provided at the front end of the hood. So long as the support strut is attached, the hood can pivot about the axle and the follower will move in the guide track on the frame, but the hood cannot be removed because the follower cannot leave the track. To remove the engine hood, the support strut is detached from the hood. The follower then can pivot entirely free of the track and the hood can simply be lifted off of the axle support. The support strut preferably is an outwardly biased pre-loaded gas pressurized spring reaching its shortest length somewhere between the open and closed positions of the hood. The spring then will bias the hood towards its open and closed positions.

6 Claims, 1 Drawing Sheet

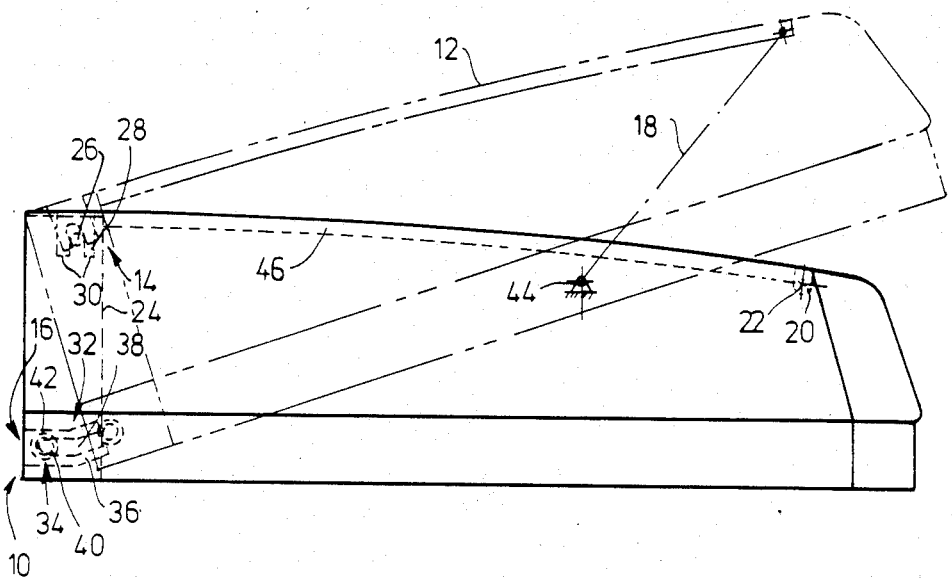
12
18
26
28
14
30
24
46
44
22
20
16
32
38
42
34
36
40
10

SUSPENSION MECHANISM FOR A HINGED PART

BACKGROUND OF THE INVENTION

1. Field of the Invention

The present invention relates to a mechanism for pivotally suspending a hinged part, in particular an engine hood of a motor vehicle, from a frame or similar structure, in a manner which allows it to be readily removed from the frame.

2. Description of the Related Art

West German Pat. No. 26 42 110 teaches a suspension mechanism for the engine hood of an agricultural tractor. The engine hood is pivoted from a simple hinge at its rear end, so that the forward end of the vehicle can be opened to provide access for maintenance. The forward end of the engine hood is supported in its open position by a simple support strut.

This arrangement has the disadvantage that to remove the engine hood, as may be needed for more extensive maintenance such as engine removal, the hinge must be disassembled. This process is time-consuming and requires special tools.

SUMMARY OF THE INVENTION

The purpose of the present invention is to provide a suspension mechanism for a hinged part, in particular an engine hood, that pivotally supports the engine hood while simultaneously allowing easy and rapid removal of the engine hood, when desired.

This purpose is met by supporting the top of the rear end of the engine hood on a bearing, while the bottom of the rear end engages a stop (preferably via a cam follower which moves along a guide track on the vehicle frame). The stop retains the hinged part against unintentional removal, but can be disengaged to allow the hinged part to be removed for the necessary maintenance access. In particular, once the stop is disengaged, the hood can simply be lifted off the bearing.

In the preferred embodiment, the stop is formed by an open-ended guide track designed to be effective over only part of the path of rotation of the engine hood. A cam follower on the hood engages the guide track, but automatically will disengage from the guide track at one end thereof. The engine hood then can be lifted off the bearing.

In a further preferred embodiment, an outwardly biased gas pressurized spring is used as a support for the forward end of the engine hood. If the gas pressurized spring is attached such that it has an over-center position near but not at the closed position of the hood, the spring can be used to open the hood over most of its movement distance, and to retain the hood in either its open or closed position.

To minimize manufacturing costs, it is preferable for the engine hood to have a bow reinforcing the rear end thereof. The cam follower and bearing can be attached to the bow before it is attached to the hood. Such a preassembled bow then can be attached to covers of various sizes. Alternatively, a flat frame can be used in place of the bow and then attached to the cover by welding or bolting.

Finally, a hood reinforcement brace preferably is provided between the bow and the attachment point for the gas pressurized spring to absorb and distribute the forces generated by the spring.

BRIEF DESCRIPTION OF THE DRAWING

The single FIGURE shows a side view of a hinged part in various positions and mounted according to the present invention. For convenience, throughout this specification the right side of the FIGURE will be referred to as the forward end of the hinged part and the left side of the FIGURE as the rear end of the hinged part.

DETAILED DESCRIPTION OF THE PREFERRED EMBODIMENT

A suspension 10 for a hinged part 12 includes a bearing 14 and a stop 16 at the rear end of the hinged part 12. The suspension 10 and the hinged part 12 are arranged symmetrically about a longitudinal center plane parallel to the plane of the drawing. In addition, a support 18 is provided at the forward end of the hinged part 12 to hold the hinged part 12 in its open position, shown in dashed lines.

The hinged part 12 is shown in this example as an engine hood of an agricultural tractor, with a somewhat U-shaped cross section extending into the drawing and closed at its front end as shown. A bracket 20 is mounted inside the front end of the hinged part 12 and has a hole 22 which engages a retaining pin, not shown, for attaching one end of the support 18. A bow 24 is welded to the inside of the rear end of the hinged part 12 as a reinforcement and supports engagement members of the bearing 14 and stop 16, further described below. The front end of the hinged part 12 may be provided with locking elements, not shown, to retain the hinged part 12 in its closed position, shown in solid lines.

The bearing 14 consists of a transverse axle 26 attached to the frame, not shown, which carries the entire hinged part 12. The transverse axle 26 is arranged parallel to the axis of rotation of the hinged part 12. The transverse axle 26 preferably consists of a simple round steel bar, which, in this example, is located horizontally and perpendicular to the vehicle axis of the vehicle carrying the engine hood.

A bracket 28 attached to the bow 24 is designed as a fork with two legs 30, which are spaced to accommodate the transverse axle 26. The depth of the fork is somewhat greater than the diameter of the transverse axle 26, so that the legs 30 extend beyond the transverse axle 26. Depending upon the width of the hinged part 12, one or more brackets 28 may be provided, aligned with each other and each engaging the transverse axle 26. All such brackets 28 are spaced from the rear end of the hinged part 12, for example, by about 10 centimeters, to allow clearance for the hinged part 12.

The stop 16 consists of a guide 32 and a cam follower 34 guided thereby. Preferably, the follower 34 is attached to the bow 24 and the guide 32 is attached to the frame. The guide 32 is formed by a plate 36 with a guide track 38 formed therein which initially is directed horizontally and then with a slightly rising slope. The layout of the guide track 38 thus corresponds generally to an arc centered about the transverse axle 26 and hence about the bearing 14. A guide 32 preferably is provided on each side of the hinged part 12.

The follower 34 is formed by a shaft 40 and a head 42, where the diameter of the shaft 40 is slightly less than the width of the guide track 38, so that the follower 34 can slide in the guide track 38. The head 42 serves to provide a side restraint for the hinged part 12. The length of the guide track 38 is designed so that the shaft 40 leaves the guide track 38 when the engine hood is raised by about 30 degrees.

The support strut 18 extends from an atachment point 44 on the frame to the bracket 20 provided on the underside of the hinged part 12. The support 18 preferably is an outwardly biased pre-loaded gas pressurized spring which reaches its shortest length, i.e., its over-center position, near but not at the closed position of the hinged part 12. After passing through its dead center position, the spring will tend to elongate, with the result that the hinged part 12 is forced toward its open or closed positions. Alternatively, the support 18 can be a simple rod, but this support would not provide the advantages of the gas pressurized spring.

A hood reinforcement brace 46 preferably is provided on the hood between the bracket 20 and the bracket 28 to absorb and distribute the forces generated by the gas pressurized spring.

In use, with the hinged part 12 initially in its closed position and after any locking elements have been opened, the hinged part 12 is grasped at its front end and lifted. After the hinged part 12 has been lifted beyond the dead center position of the support 18, the gas pressurized spring will elongate and swing the hinged part 12 upward. During this process, the shaft 40 of the follower 34 will move in the guide track 38 towards the open end thereof. The bracket 28 will pivot about the transverse axle 26, preventing the gas pressurized spring from forcing the hinged part 12 forward. The hinged part 12 will stop in its open position, which is fully adequate for normal maintenance work, when the gas pressurized spring reaches its maximum length.

If the hinged part 12 is to be removed completely, the retaining pin which connects the support 18 to the bracket 20 is removed. The hinged part 12 then is raised so that the shaft 40 leaves the guide track 38 completely, the bracket 28 is lifted off of the transverse axle 26, and the hinged part 12 removed. These steps are simply reversed to remount the hinged part 12 on the frame.

Since the bracket 28 is spaced from the rear end of the hinged part 12, the rear end of the hinged part 12 will move in a circular path during rotation, which will move the hinged part 12 away from interference with any adjoining structure, such as a cab.

While the present invention has been described with reference to a particular embodiment, it is not intended to be limited thereby, but only by the following claims.

We claim:

1. A suspension mechanism for removably suspending a hinged part from a frame, comprising:

a transverse axle mounted to the frame;

a bearing mounted to the hinged part, said bearing being pivotal about said axle when mounted thereon and being selectively removable from said axle in a direction radial to said axle; and stop means permitting rotation of said hinged part about said axle and forcing limited movement thereof radial to said axle over at least part of a path of rotation of said hinged part, thereby holding said bearing on said axle over said part of said path while simultaneously moving said hinged part radially relative to said axle.

2. The suspension mechanism of claim 1, wherein said stop means comprises:

a guide mounted on one of said frame and said hinged part; and a follower guided by said guide and mounted on the other of said frame and said hinged part.

3. The suspension mechanism of claim 2, wherein said guide has a guide track formed therein with a first substantially straight part and a second substantially arc-shaped part, said arc being centered about said axle and said follower being guided in said guide track.

4. The suspension mechanism of claim 3, wherein said guide track has one open end adjacent said arc-shaped part and one closed end adjacent said straight part.

5. The suspension mechanism of claim 1, wherein said hinged part is pivotal between an open and a closed position and further comprising a pre-loaded gas pressurized spring extending between said frame and said hinged part, said spring serving as a support to hold said hinged part in at least one of said open and closed positions.

6. The suspension mechanism of claim 5, wherein said gas pressurized spring is biased outwardly and reaches a minimum length between said open and closed positions, whereby said spring biases said hinged part towards one of said positions.

* * * * *